US011732210B2

(12) United States Patent
Renouf et al.

(10) Patent No.: US 11,732,210 B2
(45) Date of Patent: Aug. 22, 2023

(54) MARINE ENGINE LUBRICATION

(71) Applicant: Infineum International Limited, Abingdon (GB)

(72) Inventors: Louise Renouf, Didcot (GB); Stuart A. Taylor, Reading (GB); Philip J. Woodward, Reading (GB)

(73) Assignee: INFINEUM INTERNATIONAL LIMITED

( * ) Notice: Subject to any disclaimer, the term of this patent is extended or adjusted under 35 U.S.C. 154(b) by 0 days.

(21) Appl. No.: 16/205,383

(22) Filed: Nov. 30, 2018

(65) Prior Publication Data

US 2019/0169528 A1 Jun. 6, 2019

(30) Foreign Application Priority Data

Dec. 1, 2017 (EP) ..... 17204927

(51) Int. Cl.

| | |
|---|---|
| ***C10M 169/04*** | (2006.01) |
| ***C10M 165/00*** | (2006.01) |
| ***C10M 129/54*** | (2006.01) |
| ***C10M 135/10*** | (2006.01) |
| ***C10M 145/36*** | (2006.01) |
| ***C10M 161/00*** | (2006.01) |
| *C10N 10/04* | (2006.01) |
| *C10N 30/04* | (2006.01) |
| *C10N 30/10* | (2006.01) |
| *C10N 30/12* | (2006.01) |
| *C10N 30/00* | (2006.01) |
| *C10N 40/25* | (2006.01) |

(52) U.S. Cl.

CPC ..... *C10M 169/044* (2013.01); *C10M 129/54* (2013.01); *C10M 135/10* (2013.01); *C10M 145/36* (2013.01); *C10M 161/00* (2013.01); *C10M 165/00* (2013.01); *C10M 2203/003* (2013.01); *C10M 2207/028* (2013.01); *C10M 2207/262* (2013.01); *C10M 2209/108* (2013.01); *C10M 2215/28* (2013.01); *C10M 2219/046* (2013.01); *C10N 2010/04* (2013.01); *C10N 2030/04* (2013.01); *C10N 2030/10* (2013.01); *C10N 2030/12* (2013.01); *C10N 2030/24* (2020.05); *C10N 2030/52* (2020.05); *C10N 2040/252* (2020.05); *C10N 2040/253* (2020.05)

(58) Field of Classification Search

CPC ..... C10M 2207/262; C10M 2219/046; C10M 2209/108; C10M 2203/003; C10N 2240/103; C10N 2230/04; C10N 2230/52; C10N 2040/26; C10N 2010/04; C10N 2030/12

See application file for complete search history.

(56) References Cited

U.S. PATENT DOCUMENTS

| | | | | |
|---|---|---|---|---|
| 4,493,776 | A | 1/1985 | Rhodes | |
| 4,876,020 | A * | 10/1989 | Zon | C10M 159/22 508/460 |
| 5,397,486 | A | 3/1995 | Small | |
| 2016/0215234 | A1* | 7/2016 | Jukes | C10M 135/02 |

FOREIGN PATENT DOCUMENTS

| | | |
|---|---|---|
| EP | 0296674 A1 | 12/1988 |
| EP | 0311166 A1 | 4/1989 |
| EP | 2909292 | 8/2015 |

* cited by examiner

*Primary Examiner* — Vishal V Vasisth

(57) ABSTRACT

An additive concentrate package for a marine engine cylinder lubricant is made by mixing an oil of lubricating viscosity, a metal detergent and an oil-soluble alkoxylated alcohol.

18 Claims, No Drawings

MARINE ENGINE LUBRICATION

FIELD OF THE INVENTION

This invention relates to the lubrication of two-stroke marine diesel internal combustion engines, usually being referred to as cross-head engines. Lubricants for this application are usually known as marine diesel cylinder lubricants ("MDCL's").

BACKGROUND OF THE INVENTION

Cross-head engines are slow engines with a high to very high power range. They include two separately-lubricated parts: the piston/cylinder assembly lubricated, with total-loss lubrication, by a highly viscous oil (an MDCL); and the crankshaft lubricated by a less viscous lubricant, usually referred to as a system oil.

MDCL's are routinely formulated with metal detergent additives and prepared from additive packages (or concentrates) including such detergents and other additives. A practical problem in use of detergents for this purpose is that certain combinations of salicylate and sulfonate detergents exhibit stability problems in such concentrates evidenced by gel or phase separation.

The aim of this invention is to reduce or overcome such problems without adversely affecting other properties.

Mortier, Fox and Orszulik in paragraph 13.8.2 of "Chemistry and Technology of Lubricants (3rd Edition)" state that the high base number of MDCL's requires the use of large amounts of overbased detergents; and that mixing of additives in high concentration can cause interactions leading to colloidal instability and deposits, mainly of calcium carbonate.

Polyoxyethylene alkyl ethers (also referred to as alkoxylated alcohols) are described in WO 2014/107315 A1 ('315) as lubricant additives for improving fuel efficiency while maintaining or improving high temperature wear, deposit and varnish control. '315 does not however mention stability benefits in marine lubricants or additive concentrate packages (sometimes referred to as "concentrates") for marine lubricants.

EP-A-0 296 674 ("674") describes a lubricating oil composition comprising a lubricating base oil, one or more overbased alkaline earth metal salts of an aromatic carboxylic acid, and as a stabilising agent a polyalkoxylated alcohol having a molecular weight from 150 to 1500.

WO-A-2015/023575 ("575") describes a process to prepare a detergent in the presence of a polyether compound, a lubricating composition containing the detergent, and use of the lubricating composition in an internal combustion engine.

SUMMARY OF THE INVENTION

The present invention meets the stability need without causing harms problems, unexpectedly, without the need to modify detergents during their preparation.

The present invention provides in one aspect a method of preparing an additive concentrate for a marine engine lubricating oil composition:

(i) comprising the steps of providing as separate additive components:

(A) at least one overbased metal detergent, and (B) an oil-soluble alkoxylated alcohol, having an HLB, in the range 7-9.5, such as 9-9.5, represented by the formula $$R—[O—(CH_2)_x]_y—OH$$

where R is a linear alkyl group having from 12 to 20 carbon atoms; x is an integer from 1 to 10, such as 1-8, 1-6, or 1-4; and y is an integer from 2 to 10, such as 2 to 8, 2 to 6, or 2 to 4; the ratio of x to y being such as to provide an HLB in the above range; and (ii) admixing an oil of lubricating viscosity in a concentrate-forming amount with additive comprising additive components (A) and (B).

Preferably, the HLB is determined by the method of William C Griffin, as described hereafter.

In a second aspect, it provides an additive concentrate obtained or obtainable by the method of the first aspect of the invention.

In a third aspect, it provides a two-stroke engine, marine cylinder lubricating oil composition comprising an oil of lubricating viscosity in a major amount blended with a minor amount of the additive concentrate of the second aspect of the invention, where the composition has a TBN of 10-200, preferably 40-140.

The additive concentrate is preferably used at a treat rate of 15 to 50 mass % to produce the composition.

The lubricating oil composition preferably includes from 1-5 mass % of additive (B).

In further aspects the present invention comprises:

a method of operating a two-stroke marine engine in which the engine is lubricated by the composition of the third aspect of the invention during its operation; and the use of additive (B) as defined in the first aspect of the invention in an additive concentrate for preparing a two-stroke, cross-head, marine diesel cylinder lubricant that contains additives (A) and (B) as defined above to improve the stability of the additives in the additive concentrate package or the composition, and to improve the viscosity of the package, and to control or improve rust performance.

Definitions

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a substituent or group (such as an alkyl group) having a carbon atom directly attached to the remainder of a molecule and having a predominantly hydrocarbon character. Hetero atoms may be present provided they do not alter the essentially hydrocarbon nature of the group.

"major amount" means 50 mass % or more of a composition, preferably 60 mass % or more, even more preferably 70 mass % or more, and most preferably 80 mass % or more;

"minor amount" means less than 50 mass % of a composition, preferably less than 40 mass %, even more preferably less than 30 mass %, most preferably less than 20 mass %, and most preferably less than 10 mass %;

"TBN" means total base number as measured by ASTM D2896;

"HLB" means the hydrophile-lipophile balance of a molecule on a scale determined according to the method of William C. Griffin. The method is to described in Griffin, William C (1954), "Calculation of HLB Values of Non-Ionic Surfactants", Journal of Society of Cosmetic Chemists, 5(4): 249-56. HLB is a measure of the degree to which a molecule is hydrophilic or lipophilic, i.e. its solubility in water or oil. HLB by Griffin's method is determined by multiplying, by 20, the ratio of the molecular mass of the hydrophilic portion of the molecule to the molecular mass of the whole molecule. Thus, HLB values by this method are on a scale of 0 to 20.

Furthermore in this specification, if and when used:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be discussed in more detail below.

Oil of Lubricating Viscosity

Such lubricating oils may range in viscosity from light distillate mineral oils to heavy lubricating oils. Generally, the viscosity of the oil ranges from 2 to 40, such as 3 to 15, $mm^2$/sec, as measured at 100° C., and has a viscosity index of 80 to 100, such as 90 to 95.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivatives, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment are unrefined oils.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention preferably embraces those of the above oils containing greater than or equal to 90% saturates and less than or equal to 0.03% sulphur as the oil of lubricating viscosity, e.g. Group II, III, IV or V. They also include basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil. The invention is not however limited to use of the above-mentioned base stocks; thus, it may for example, include use of Group I basestocks and of bright stock.

Preferably, the oil of lubricating viscosity in this invention contains 50 mass % or more of said basestocks. It may contain 60, such as 70, 80 or 90, mass % or more of said basestock or a mixture thereof. The oil of lubricating viscosity may be substantially all of said basestock or a mixture thereof.

Additive (A)

A detergent is an additive that reduces formation of deposits, for example, high-temperature varnish and lacquer deposits, in engines; it has acid-neutralising properties and is capable of keeping finely-divided solids in suspension. It is based on metal "soaps", that is metal salts of acidic organic compounds, sometimes referred to as surfactants.

A detergent comprises a polar head with a long hydrophobic tail. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The detergent is preferably an alkali metal or alkaline earth metal additive such as an overbased oil-soluble or oil-dispersible calcium, magnesium, sodium or barium salt of a surfactant selected from an acid, wherein the overbasing is provided by an oil-insoluble salt of the metal, e.g. carbonate, basic carbonate, acetate, formate, hydroxide or oxalate, which is stabilized in an oleaginous diluent by the oil-soluble salt of the surfactant. The metal of the oil-soluble surfactant salt may be the same as or different from that of the metal of the oil-insoluble salt. Preferably the metal, whether the metal of the oil-soluble or oil-insoluble salt, is calcium.

The detergent may be a complex in the form of a hybrid in which different surfactant groups are incorporated during the overbasing process. Such detergents are known in the art.

The TBN of the detergent may be low, i.e. less than 50 mg KOH/g; medium, i.e. 50-150 mg KOH/g; or high, i.e. over 150 mg KOH/g, as determined by ASTM D2896. Preferably the TBN is medium or high, i.e. more than 50 TBN. More preferably, the TBN is at least 60, more preferably at least 100, more preferably at least 150, and up to 500, such as up to 350, mg KOH/g as determined by ASTM D2896.

In detergent (A), the surfactant may be selected from a hydroxybenzoic acid, a particular example being a salicylic acid and wherein the salt is a salicylate, salicylate detergents being known in the art; and/or may be selected from a sulfonic acid wherein the salt is a sulfonate, sulfonate detergents also being known in the art.

Detergents that may be used are those that are hydrocarbyl (such as alkyl) substituted, such as those known in the art.

Additive (B):

In additive (B) group R can be pure or be mixtures.

Illustrative of group R are alkyl groups that include, for example, dodecyl, tridecyl, myristyl, palmityl and stearyl groups.

As stated R is a linear alkyl group having from 12 to 20 carbon atoms.

R is preferably a lauryl group. These alkyl groups can be pure or mixtures. Commercially, lauryl groups are mixtures (e.g. mixtures groups with slightly different chain lengths).

The integer x ranges from 1 to 10 preferably 1 to 5, in other words, $—(CH_2)_x$ is an alkylene group, preferably an alkylene group having 2 to 4 carbon atoms, e.g., an ethylene, propylene, or butylene group or mixtures.

The integer y ranges from 2 to 10, in other words, the compound of formula (1) may be a regarded as a polyalkoxylated alcohol; y is preferably 2 to 5, more preferably 2 to 4. The polyalkoxylated alcohol may be used alone or as a mixture of alkoxylated alcohols.

In the first aspect of the invention the content of the alkoxylated alcohol (B) is preferably 0.25 to 5, such as 1 to 5, such as 3 to 4, mass %.

The content of the alkoxylated alcohol is preferably 0.01 to 5 more preferably 0.1 to 3, such as 0.5 to 2, such as 0.5 to 1.5, mass % of the lubricating oil composition of the third aspect of the invention.

Marine Lubricants and Concentrates

Marine Diesel Cylinder Lubricant ("MDCL")

An MDCL may employ 10-65, preferably 12-50, most preferably 13-25, mass % of the concentrate additive package, the remainder being base stock. It preferably includes at least 50, more preferably at least 60, even more preferably at least 70, mass % of oil of lubricating viscosity based on the total mass of MDCL. Preferably, the MDCL has a compositional TBN (using ASTM D2896) of 10-200, such as 70-160, more preferably 70-140.

The following may be mentioned as examples of typical proportions of additives in the MDCL, additional to additive (B) of this invention.

| Additive | Mass % a.i. (Broad) | Mass % a.i. (Preferred) |
|---|---|---|
| detergent(s) | 1-20 | 3-15 |
| dispersant(s) | 0.5-5 | 1-3 |
| anti-wear agent(s) | 0.1-1.5 | 0.5-1.3 |

-continued

| Additive | Mass % a.i. (Broad) | Mass % a.i. (Preferred) |
|---|---|---|
| pour point dispersant | 0.03-1.15 | 0.05-0.1 |
| base stock | balance | balance |

One or more additive concentrate packages comprising the additives, (including at least one package of the invention) are blended in the oil of lubricating viscosity to form the lubricating oil composition. Dissolution of the additive package(s) into the lubricating oil may be facilitated by solvents and by mixing accompanied with mild heating, but this is not essential. The additive concentrate package(s) will typically be formulated to contain the additive(s) in proper amounts to provide the desired concentration, and/or to carry out the intended function in the final formulation when the additive concentrate package(s) is/are combined with a predetermined amount of base lubricant.

Additives of the invention are admixed with small amounts of base oil or other compatible solvents together with other desirable additives to form the additive concentrate packages containing active ingredients in an amount, based on the additive package, of, for example, from 2.5 to 90, preferably from 5 to 75, most preferably from 8 to 60, mass % of additives in the appropriate proportions, the remainder being base oil.

The MDCL formulations of the invention may typically contain about 5 to 40 mass % of the additive packages(s), the remainder being base oil and/or may comprise greater than 60, typically greater than 70, mass % of oil of lubricating viscosity.

EXAMPLES

The present invention is illustrated by, but not limited to, the following examples.

Example 1

An additive package (referred to as the Example 1 Package) for a two-stroke marine diesel engine cylinder lubricant was made by blending a succinimide dispersant (14.020 mass %); a complex phenate/sulfonate detergent (81.310 mass %); a polyoxyethylene (4) C12/14 straight chain alkyl ether (3.740 mass %) having an HLB of 9.42 and diluent (0.930 mass %).

As a comparison, an identical package, but lacking the ether was made, and is referred to as the Reference Package.

Tests and Results

Test results of the Example 1 and Reference packages for stability and of the Example 1 package for viscosity growth are summarised in the tables below, stability being tested visually and viscosity being tested using ASTM D445 at both 40° C. and 100° C.

TABLE 1

PACKAGE STABILITY

| | Reference Package | | Example 1 Package | |
|---|---|---|---|---|
| Time | Ambient | 60° C. | Ambient | 60° C. |
| Day 1 | No sediment, Dark in colour | No sediment, Dark in colour | CB | CB |

TABLE 1-continued

PACKAGE STABILITY

| | Reference Package | | Example 1 Package | |
|---|---|---|---|---|
| Time | Ambient | 60° C. | Ambient | 60° C. |
| Week 1 | Very thick, slight gelling | Very think, no sediment | CB | CB |
| Week 2 | Very thick, slight gelling | Gelled, no sediment | CB | CB |
| Week 4 | Very thick, slight gelling | Gelled, no sediment | CB | CB |
| Week 6 | Very thick, slight gelling | Gelled, no sediment | CB | CB |
| Week 8 | Very thick, slight gelling | Gelled, no sediment | CB | Hard sediment <0.001% |
| Week 10 | Very thick, slight gelling | Gelled, no sediment | CB | Hard sediment <0.001% |
| Week 12 | Very thick, slight gelling | Gelled, no sediment | CB | Hard sediment <0.001% |

CB = clear and bright (visual evaluation)

TABLE 2

VISCOSITY GROWTH, 60° C.

| Time | Viscosity ($mm^2/s$) |
|---|---|
| Day 1 | 99.19 |
| Week 1 | 99.32 |
| Week 2 | 103.1 |
| Week 3 | 103.9 |
| Week 4 | 104.7 |
| Week 6 | 105.2 |
| Week 8 | 105.5 |
| Week 10 | 105.7 |
| Week 12 | 105.5 |
| KV40 | 1453 |
| KV100 | 101.3 |
| KV growth % | 6.36 |

The results show that the Example 1 Package exhibited both good visual stability performance (better than that of the Reference Package), and good viscosity stability performance. Thus, absence of the ether (or alkoxylated alcohol) caused stability problems. The Example 1 Package contained products that are not recorded as being "Substances of Very High Concern".

Example 2

Three additive packages were made as described in Example 1, i.e. containing 3.740 mass % of the ether.

One was a package of the invention containing a polyoxyethylene (4) C12/14 straight chain alkyl ether, one was a reference package containing a polyoxyethylene (4) C10/12 straight chain alkyl ether; one was a reference package containing a polyoxyethylene (4) C12 straight chain alkyl ether.

Each package was subjected to a viscosity test using ASTM D445 when stored at 60° C. for eight weeks.

Each package was blended to give an MDCL containing 21.4 mass % of the other and to have a TBN (D2896) of 72.3.

Each package was subjected to rust test after 24 hours using ASTM D6658.

Results

These are summarized in the table below.

| Ether Alkyl Chain Length | HLB | Viscosity ($mm^2/s$) | Rust |
|---|---|---|---|
| C12/14 (50:50) | 9.42 | 146.0 | PASS |
| C12 | 9.72 | 203.6 | PASS |
| C10/12 (50:50) | 10.07 | 146.6 | FAIL (medium rusting) |

It is seen that the 9.42 HLB ether achieved satisfactory results in both tests whereas the higher HLB ethers failed or gave a poor performance in one of the tests.

It is noted that the ethoxylated alkanols described in TABLE 1 of EP-A-0 296 674 had even higher HLB values than those tested, namely 12.09/13.02 for ethoxylated $C_{9-11}$ alkanols having 5 ethoxy groups, and 13.24/14.19 for ethoxylated $G_{2-15}$ alkanols having 9 ethoxy groups.

What is claimed is:

1. A method of preparing an additive concentrate for a marine engine lubricating oil composition having both viscosity stability at 60° C. and rust inhibitory characteristics:

(i) comprising the steps of providing as separate additive components:

(A) at least one overbased metal detergent; and (B) an oil-soluble alkoxylated alcohol, having an HLB in the range 7-9.5, represented by the formula $R[O—(CH_2)_x]_y—OH$ where R is a linear alkyl group having from 12 to 20 carbon atoms, x is an integer from 1 to 10, and y is an integer from 2 to 10; the ratio of x to y being such as to provide an HLB in the above range; and (ii) admixing an oil of lubricating viscosity in a concentrate-forming amount with additive comprising additive components (A) and (B), so as to provide a marine engine lubricating oil composition having both viscosity stability at 60° C. and rust inhibitory characteristics.

2. The method of claim 1 wherein the additive concentrate contains from 2.5 to 90 mass % of additive.

3. The method of claim 1 wherein the additive concentrate contains from 0.25 to 5 mass % of additive (B).

4. A viscosity-growth-stable and rust inhibitory additive concentrate obtained by the method of claim 1.

5. A two-stroke engine marine cylinder lubricating oil composition comprising an oil of lubricating viscosity in a major amount blended with a minor amount of the viscosity-growth-stable and rust inhibitory additive concentrate claimed in claim 4, where the composition has a TBN of 10-200 mg KOH/g, a passing rust test result according to ASTM D6658, and a viscosity increase when stored for eight weeks at 60° C. according to ASTM D445 of at most 47.2%.

6. The composition of claim 5 comprising 10 to 65 mass % of the additive concentrate.

7. The composition of claim 6 comprising 12 to 50 mass % of the additive concentrate.

8. The composition of claim 7 comprising 13 to 25 mass % of the additive concentrate.

9. The composition of claim 5 containing 0.1 to 3 mass % of additive (B).

10. The composition of claim 5 including at least 60 mass % of the oil of lubricating viscosity.

11. The additive concentrate of claim 4 wherein (A) is an overbased calcium phenate detergent and/or an overbased calcium sulfonate detergent, or is a complex detergent comprising sulfonate and phenate surfactants.

12. The additive composition of claim 5 wherein (A) is an overbased calcium phenate detergent and/or an overbased calcium sulfonate detergent, or is a complex detergent comprising sulfonate and phenate surfactants.

13. The additive concentrate of claim 4 wherein x is 2 and y is 4.

14. The additive composition of claim 5 wherein x is 2 and y is 4.

15. The additive concentrate or composition of claim 4 wherein (B) comprises a polyoxyethylene (4) lauryl ether.

16. The additive composition of claim 5 wherein (B) comprises a polyoxyethylene (4) lauryl ether.

17. A method of operating a two-stroke marine engine in which the engine is lubricated by the composition of claim 5 during its operation.

18. The additive composition of claim 5, wherein the TBN is 40-140 mg KOH/g.

* * * * *